US006690001B2

(12) United States Patent
Jiang et al.

(10) Patent No.: US 6,690,001 B2
(45) Date of Patent: Feb. 10, 2004

(54) THZ PULSE MEASUREMENT WITH AN OPTICAL STREAK CAMERA

(75) Inventors: Zhiping Jiang, Ottawa (CA); Xi-Cheng Zhang, Latham, NY (US)

(73) Assignee: Rensselaer Polytechnic Institute, Troy, NY (US)

( * ) Notice: Subject to any disclaimer, the term of this patent is extended or adjusted under 35 U.S.C. 154(b) by 141 days.

(21) Appl. No.: 09/826,457

(22) Filed: Apr. 5, 2001

(65) Prior Publication Data

US 2001/0050334 A1 Dec. 13, 2001

Related U.S. Application Data

(60) Provisional application No. 60/195,555, filed on Apr. 6, 2000.

(51) Int. Cl.[7] ..... H01J 40/14

(52) U.S. Cl. ..... 250/214 VT; 324/244.1

(58) Field of Search ..... 250/214 VT, 225; 313/103 CM; 324/244.1, 96, 637

(56) References Cited

U.S. PATENT DOCUMENTS

| | | | | | |
|---|---|---|---|---|---|
| 4,857,748 | A | * | 8/1989 | Takiguchi | 250/559.21 |
| 5,032,714 | A | * | 7/1991 | Takahashi et al. | 250/214 VT |
| 5,949,065 | A | | 9/1999 | Kaplan et al. | 250/214 VT |
| 5,952,818 | A | | 9/1999 | Zhang et al. | 324/96 |
| 6,049,079 | A | | 4/2000 | Noordam et al. | 250/338.1 |
| 6,185,033 | B1 | | 2/2001 | Bosc et al. | 359/254 |

OTHER PUBLICATIONS

Jiang et al. "Terahertz pulse measurement with an optical streak camera", Optics Letters, vol. 24, No. 17, Sep. 1, 1999.*

Zhang et al., "Electro–optic Sensor of THz Imaging and Spectroscopy", May 18–23, 1997, Summaries of Papers Presented at the Quantum Electronics and Laser Science Conference, pp. 80–81.*

Zhang, "Generation and Detection of Pulsed Microwave Signals by THz optoelectronics", Aug. 11–14, Microwave and Optoelectronics Conference, Linkin Next Century. Proceedings, pp. 215–220.*

Mourou et al., Appl. Phys. Lett. 38, 470 (1981).
Auston et al., Appl. Phys. Lett. 45, 284 (1984).
DeFonzo et al., Appl. Phys. Lett. 50, 1155 (1987).
Fattinger et al., Appl. Phys. Lett. 53, 1480 (1988).
Hu et al., Appl. Phys. Lett. 56, 866 (1990).
Wu et al., Appl Phys. Lett. 67, 3523 (1995).
Nahata et al., Appl. Phys. Lett. 68, 150 (1996).
Jepsen et al., Phys. Rev. E 53, 3052 (1996).
Jiang et al., Appl. Phys. Lett. 72, 1945–1947 (1997); Opt. Lett. 23, 1114 (1998).
Sun et al., Appl. Phys. Lett. 73, 2233 (1998).
Drabbels et al., Opt. Lett. 22, 1436 (1997).
Drabbels et al., IEEE.J. of Quantum Electron. 34, 2138 (1998).
Drabbels et al., Appl. Phys. Lett. 74 (1999).
Wu et al., Appl. Phys. Lett. 71, 1285 (1997).
Han et al., Appl. Phys. Lett. 73, 3049 (1998).
Leitenstorfer et al., Appl. Phys. Lett. 74, 1516 (1999).
Jiang et al., Appl. Phys. Lett. 74, 1191 (1999).

(List continued on next page.)

*Primary Examiner*—Thanh X. Luu
(74) *Attorney, Agent, or Firm*—RatnerPrestia

(57) ABSTRACT

A method and apparatus for measuring electromagnetic pulses as a function of time. Radiation measurement, including measurement of single-shot, free-space terahertz femtosecond pulses, is realized using an electro-optical modulator in combination with an optical streak camera. This method and apparatus allow measurement of electromagnetic pulses previously unmeasurable due to the time resolution restrictions dictated by the time-frequency correlation.

35 Claims, 5 Drawing Sheets

OTHER PUBLICATIONS

Chang et al., "An Electro–Optical Technique for Measuring High Frequency Free Space Electric Field," Fast Electrical and Optical Measurement, Edited by J.E. Thompson and L.H. Luessen, NATO ASI Series, Series E: Applied Science—No. 108, 57 (1983).

Williamson et al., "Picosecond Electro–Electron Optic Oscilloscope," Picosecond Electronics and Optoelectronics, Ed. G. A. Mourou, D. M. Bloom, and C.–H Lee, Springer–Verlag, 58 (1985).

* cited by examiner

THZ PULSE MEASUREMENT WITH AN OPTICAL STREAK CAMERA

CROSS-REFERENCE TO RELATED APPLICATIONS

This application claims priority based upon U.S. Provisional Patent Application Ser. No. 60/195,555, filed on Apr. 6, 2000, which is incorporated herein by reference.

TECHNICAL FIELD

The present invention relates generally to the time dependent measurement of optical pulses and, more specifically, to the time dependent measurement of terahertz (THz) frequency pulses using an optical streak camera.

BACKGROUND OF THE INVENTION

Freely propagating terahertz (THz) pulses are usually measured by sampling techniques such as photoconductive antenna or electro-optical (EO) sampling. Although these sampling techniques provide good signal-to-noise ratios and adequate temporal resolution, they cannot be used for measurement on a single-shot basis. Recently, a chirped pulse measurement technique, which is based on an electro-optic effect and wavelength division by multiplexing and demultiplexing, has been demonstrated for single-shot THz waveform measurement and one-dimensional imaging. Such progress makes it possible to study the unrepeatable events on a single-shot basis. Another electro-optical sensing technique is described in U.S. Pat. No. 5,952,818 issued to Zhang et al., incorporated herein by reference.

Theoretical analysis of the chirped pulse techniques shows, however, that temporal resolution of the chirped pulse measurement is given by the equation $\Delta T=(T_c\ T_o)^{1/2}$, where $T_c$ and $T_o$ are the duration of the chirped and unchirped pulse, respectively. Therefore $\Delta T\sim 5$ ps when $T_c=100$ ps and $T_o\sim 0.25$ ps. One of the factors limiting the temporal resolution in the chirped pulse measurement is the spectral bandwidth of the laser pulse. The THz pulse modulates the chirped probe pulse in the time domain, and the signal is extracted in the frequency domain. Because the chirped pulse technique is a frequency domain technique, the temporal resolution is limited due to the well-known time-frequency relation, and thus the technique is inherently limited in time resolution.

Further, because the frequency of the THz radiation limits time resolution, measurement of THz pulses faster than the theoretical time resolution requires measurement of the pulses in a time-dependent manner. Streak cameras provide optical measurements as a function of time. A streak camera measures ultrafast light pulses in the time domain using an electron tube. For direct measurement, photon energy should be high enough to free electrons from the electron tube cathode. Conventional streak cameras are only suitable for short wavelength measurement, such as X-ray, ultraviolet (UV), visible, and near infrared (IR) light, because of the material limitation of the cathode. With conventional streak cameras, longer wavelength radiation has not provided sufficient photon energy to free electrons from the cathode.

Many efforts have been made to extend the measurable radiation of conventional streak cameras to longer wavelengths. A far infrared streak camera was reported by using highly lying Rydberg state atoms. The measurable wavelength extended from near infrared to 100 $\mu$m. See Drabbels et al., Opt. Lett. 22, 1436 (1997); Drabbels et al., IEEE J. of Quantum Electron. 34, 2138 (1998); and Drabbels et al., Appl. Phys. Lett. 74 (1999). In these experiments, UV laser source was needed to pump the electrons into excited slates, and the gas atoms must be in a vacuum chamber.

About ten years ago, the streak camera was used to measure radio frequencies and microwaves indirectly with an EO modulator as a converter. The radio frequency or microwave signals were converted into intensity modulation of a continuous-wave He-Ne laser. The highest measurable frequency was limited to about 40 GHz by the bandwith of EO modulator. See Chang et al., "An Electro-Optical Technique for Measuring High Frequency Free Space Electric Field," Fast Electrical and Optical Measurement, Edited by J. E. Thompson and L. H. Luessen, NATO ASI Series, Series E: Applied Science—No. 108, 57 (1983); and Williamson et al., "Picosecond Electro-Electron Optic Oscilloscope," Picosecond Electronics and Optoelectronics, Ed. G. A. Mourou, D. M. Bloom, and C. -H. Lee, Springer-Verlag, 58 (1985). With the development of free-space EO sampling, the bandwidth has been extended to over 40 THz because the EO modulator is no longer a limiting factor. See Wu et al., Appl. Phys. Lett. 71, 1285 (1997); Han et al., Appl. Phys. Lett. 73, 3049 (1998); and Leitenstorfer et al., Appl. Phys. Lett. 74, 1516 (1999). In addition, the temporal resolution of a state-of-the-art streak camera is better than 200 fs.

Despite such improvements in the state of the art, there remains a need in the art to measure radiation pulses extending into the terahertz regime in a time-dependent manner.

SUMMARY OF THE INVENTION

To meet this and other needs, and in view of its purposes, the present invention provides a system for measuring a terahertz frequency pulse propagating in a free-space optical path. The system comprises an optical streak camera and an electro-optical modulator. The electro-optical modulator is positioned before the optical streak camera in the free-space optical path, and the streak camera measures optical intensity as a function of time. The electro-optical modulator includes an electro-optical crystal and a polarization analyzer.

This system can measure the terahertz frequency pulse in a single shot. The terahertz frequency pulse contains sub-picosecond free-space electromagnetic radiation with a bandwidth in a range from 10 gigahertz to 40 terahertz.

Another embodiment of the present invention is a system for measuring terahertz frequency pulses with a streak camera that comprises an optical streak camera and an optical source with related optics for providing a pump pulse to excite an emitter to emit terahertz frequency pulses and a probe pulse. This system also has a probe pulse stretcher and a probe pulse polarizer, as well as a trigger that synchronizes the streak camera and the probe pulse. In addition, the system has an electro-optical modulator positioned before the optical streak camera in the optical path. This electro-optical modulator contains an electro-optical crystal and a polarization analyzer. The terahertz frequency pulse generates an electric field when the pulse propagates through the electro-optical crystal. This electric field modulates the polarization of the polarized probe pulse in the electro-optical modulator, which generates a polarization modulation. The polarization modulation is converted to an intensity modulation by the polarization analyzer, and the streak camera measures the intensity modulation.

The present invention also provides a method for measuring terahertz frequency electromagnetic pulses as a function of time. The method includes the steps of: providing optical pump and probe pulses; exciting a terahertz frequency emitter with the pump pulse; stretching the probe pulse; polarizing the probe pulse; modulating the probe pulse with a local electromagnetic field generated by the emitted pulse in an electro-optical modulator, which results in a probe pulse polarization modulation; converting the polarization modulation into an intensity modulation; and measuring the intensity modulation as a function of time. The method also includes synchronizing the optical probe pulse with the streak camera.

It is to be understood that both the foregoing general description and the following detailed description are exemplary, but are not restrictive, of the invention.

BRIEF DESCRIPTION OF DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF INVENTION

The present invention addresses the need to measure terahertz (THz) frequency pulses with superior time resolution by combining free-space electro-optical (EO) sampling with an optical streak camera. The combination of free-space electro-optical sampling, in which the bandwidth has been extended to over 40 THz, with the streak camera identified below, provides temporal resolution of THz frequency pulses. In addition, the temporal resolution of a state-of-the-art streak camera is better than 200 fs, allowing measurement of previously inaccessible frequencies.

The measurement of freely propagating THz pulses is provided by using a streak camera with an EO crystal as a converter in an EO modulator. By using an EO crystal as the THz modulator in front of a conventional optical streak camera, the spectrum range of the streak camera extends from the optical region (UV, visible, and near IR) to the THz region (far infrared and millimeter waves) with minimal modification.

The present invention includes an electro-optical modulator that serves to convert the terahertz pulses into a signal that can be detected by an optical streak camera. This electro-optical modulator uses an electro-optical crystal. An electro-optic crystal is positioned so that a free-space electromagnetic field, such as a THz pulse, passes through the EO crystal. An EO crystal has an index of refraction that changes as a function of the electromagnetic field. The free-space electromagnetic field that passes through the EO crystal changes the index of refraction of the crystal.

Synchronized with the free-space electromagnetic field, an optical probe signal is generated and impinges upon the EO crystal simultaneously with the free-space electromagnetic field passing through the EO crystal. As a result of this co-propagation through the EO crystal, the optical probe signal collects information representative of the electromagnetic field passing through the crystal. The optical probe signal is detected and analyzed after passing through the crystal to determine the polarization modulation of the optical probe signal. Characterization of the free-space electromagnetic energy is achieved by evaluating this polarization modulation of the optical probe signal. This polarization modulation is converted to intensity modulation, which is measured in a time-dependent manner with a streak camera.

Figure 1:
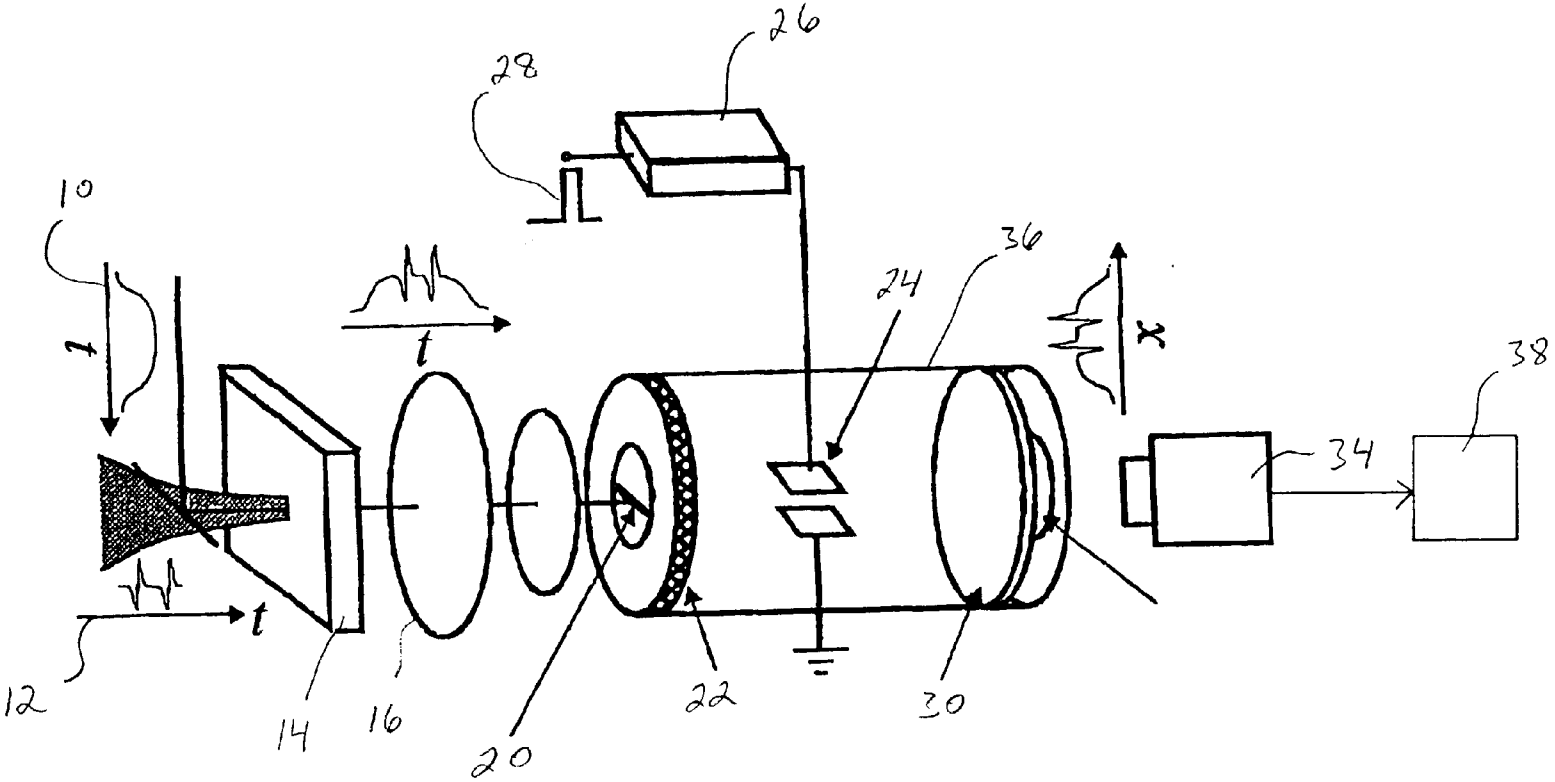
FIG. 1 is a schematic illustration of a measurement system in accordance with the present invention.

Referring now to the drawing, in which like reference numbers refer to like elements throughout, FIG. 1 shows the electro-optical modulator and streak camera elements. The THz pulses (12) and a linearly polarized stretched probe pulse (10) or probe beam are co-propagating in an EO crystal (14) such as a zinc telluride (ZnTe) crystal. The polarization of the probe pulse is modulated by the electric field of the THz pulses via Pockels effect in the EO crystal (14). This polarization modulation is converted into an intensity modulation by a polarization analyzer (16).

When the modulated probe pulse hits the photocathode (20) of the electron (cathode) tube (36) of the streak camera, photoelectrons are generated. These photoelectrons are accelerated by an accelerating mesh (22) toward the multichannel plate or MCP (30). While accelerating towards the MCP (30), the photoelectrons are deflected in a perpendicular direction (x) by the synchronized sweeping voltage provided by the sweep electrodes (24). Therefore, the electrons generated at different times hit different locations on the MCP (30). As the electrons pass the MCP (30), they are multiplied several thousand times, and then impact on the phosphor screen, which produces an imaging trace of visible light. An image of the phosphor screen is recorded by a charge-coupled device (CCD) such as a camera (34) or, alternatively, by a complementary metal-oxide-semiconductor (CMOS) device, and sent to a computer 38.

In the embodiment of the present invention illustrated in FIG. 1, the optical probe signal is oriented co-linear with the free-space electromagnetic energy passing through the EO crystal (14) in order to enhance the interaction length between the two pulses. FIG. 1 illustrates the measuring principle of the present invention, which encompasses an apparatus and a method for free-space electro-optic characterization of propagating terahertz beams as a function of time. Unlike pre-existing approaches, free-space electro-optical measurement in accordance with the present invention is not restricted by the frequency-time relationship. The term "free space" is defined to mean that the electro-optical sensor is placed remote from the electromagnetic field emitter, i.e., is placed in the "far field." Distances as far as one meter have been experimentally verified.

The sensing technique is based on a non-linear coupling between a low-frequency electric field (terahertz pulses (12)) and a laser beam (optical probe pulse (10)) in an EO crystal (14). The step of modulating birefringence of the EO crystal (14) by applying the polarized electric field to the EO crystal (14) modulates the polarization states of the optical probe pulse (10) passing through the EO crystal (14). This polarization modulation of the optical beam is then polarization-analyzed to provide information that is recorded by a streak camera. The streak camera therefore is carefully synchronized with the optical probe pulse (10).

Operationally, measurement of the electromagnetic field according to the present invention functions as follows. An electromagnetic field signal is applied to the EO crystal (14), which causes a change in low frequency polarization within the EO crystal (14). This change in low frequency polarization causes an index of refraction change within the EO crystal (14). The change in index of refraction is sensed by the optical probe signal illuminated on the EO crystal (14). The polarization analyzer (16) converts the light polarization change of the optical probe signal into a light intensity change. Finally, this light intensity change is analyzed. The change is known by one skilled in the art to be proportional to, and characteristic of, the electromagnetic field signal.

The analyzed signal is transmitted to a streak camera, in which the light intensity signal induces photoelectrons from the photocathode (20) to travel through an electron tube (36). The photoelectrons can be accelerated through the electron tube (36) with a supplemental electromagnetic field source, such as the accelerating mesh (22). The electron tube (36) contains the sweep electrodes (24) that are activated with a sweep circuit (26) activated by a trigger signal (28) synchronized to the optical probe pulse (10). This "sweeping" voltage through the sweep electrodes (24) deflects the accelerated photoelectrons in a direction perpendicular to the acceleration vector.

Because photoelectrons from the photocathode (20) are emitted at different times, the photoelectrons encounter the deflecting voltage in a time-dependent manner. Accordingly, the deflection of a photoelectron in the sweeping voltage direction is a measure of time variation for the excitation of the photoelectron. This deflection in space is measured by the location of the impact of the photoelectron on the phosphor screen of the streak camera. A visible light trace of the photoelectrons on the phosphor screen is recorded by the camera (34).

Figure 2:
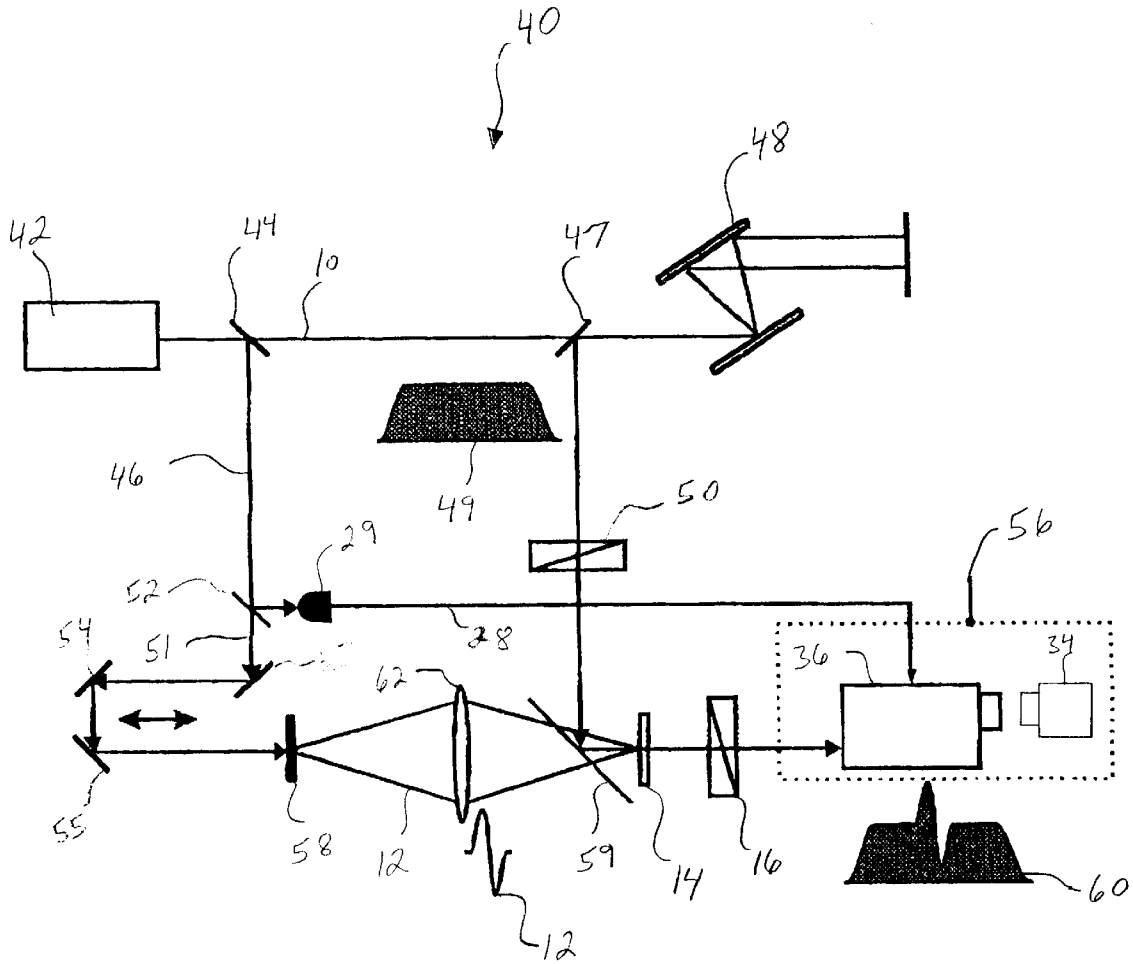
FIG. 2 is a schematic illustration of an alternate measurement system in accordance with the present invention.

FIG. 2 illustrates additional components of the apparatus of the present invention. A light source or femtosecond laser (42) provides an optical pulse which is split at a first splitter (44) to provide a probe pulse (10) and a pump/trigger pulse (46). The laser (42) may be an ultrafast Ti:sapphire laser. The probe pulse (10) is directed by an optic element (47) such that the probe pulse (10) enters a parallel pair of gratings (48), where it is stretched to form a stretched pulse (49), and polarized with a polarizer (50). The pump/trigger pulse (46) is split to provide a pump pulse (51) that eventually triggers a THz emitter (58) to generate the THz pulse (12). The THz pulse (12) and the stretched probe pulse (10) are combined and co-propagate in the EO crystal (14).

The polarization of the probe pulse (10) is modulated by the THz electric field inside the EO crystal (14) by the electro-optic effect. This polarization modulation is converted into intensity modulation by a second polarizer, namely polarization analyzer (16). The streak camera (56) is used to measure the intensity modulation of the probe pulse (10) by the THz pulse (12) in the time domain. The streak camera (56) is synchronized to the probe pulse (10) precisely. A small part of the laser pulse is isolated to illuminate on a fast positive-intrinsic-negative (PIN) diode (29) to generate the trigger signal (28). The streak camera (56) should be triggered before the arrival of the probe pulse (10), so the probe pulse (10) is delayed.

The PIN diode (29) is a semiconductor structure that has a high-resistance intrinsic region between low-resistance p-type and n-type regions. Microwave diodes, photodiodes, switching diodes, and voltage-dependent variable resistors are made with this structure.

The pump/trigger pulse (46) is split at a second splitter (52) to provide an optical trigger signal (28) and a pump pulse (51). The optical trigger used to create the trigger signal (28) may be the PIN diode (29). The trigger signal (28) triggers the sweep circuit (26) of the streak camera (56). The pump pulse (51) is directed through a mechanical delay stage, typically having optical elements (53, 54, 55), to the emitter (58). The emitter (58) emits electromagnetic radiation that comprises the terahertz frequency pulses (12).

The THz frequency pulses (12) are focused through an optical lens (62) onto the EO crystal (14). The optical probe pulse (10) is simultaneously directed into the EO crystal (14), by an optical element (59), so that the probe pulse (10) and the THz pulse (12) co-propagate in the EO crystal (14). The probe pulse polarization is modulated by the THz frequency pulse (12) during this co-propagation in the EO crystal (14), and the resulting polarization modulation is converted to an intensity modulation in the polarization analyzer (16). The resulting intensity modulation signal (60) is measured as a function of time by the streak camera (56) and recorded by a device such as the camera (34).

In one exemplary embodiment, the light source or laser (42) is a Coherent RegA 9000 laser, which delivers laser pulses with 4 $\mu$J pulse energy, 250 fs pulse duration, 830 nm wavelength, and 10 kHz repetition rate. The THz emitter (58) is a large aperture antenna, with a 4 mm gap between two electrodes on LT-GaAs, and is biased by a high-voltage DC power supply. The EO crystal (14) is a 4 mm thick<110>ZnTe crystal. In principle, it is not necessary to chirp the probe pulse (10) as long as the probe pulse (10) is long enough to cover the entire time window of the THz pulse (12). The pair of gratings (48) can conveniently elongate the probe pulse, however, to avoid any risk. The streak camera (56) in this exemplary embodiment is a Hamamatsu streak camera C1952, which has nominal 2 ps temporal resolution and 30:1 dynamic range in the single-shot mode.

The apparatus of FIG. 2, generally denoted 40, comprises a setup useful in discussing concepts in accordance with the present invention. In an alternate detailed example, a cw $Ar^+$ laser pumped, mode-locked Ti:sapphire laser (42) (coherent MIRA) provides 150 fs optical pulses at 820 nm with a 76 MHz repetition rate. The laser signal is split at the first splitter (44) to provide the probe pulse (10) and the pump/trigger pulse (46) for the optical trigger and emitter (58). The pump pulse (51) is synchronized with the probe pulse (10) via an appropriate delay stage. The emitter (58), triggered by the femtosecond laser pulses, may comprise a GaAs photoconductive emitter that radiates THz pulses (12). The planar emitter has a 2 mm photoconductive gap between electrodes. The bias field is 1.5 kV/cm and the average optical power on the emitter (58) is 400 mW. The delay stage allows the development of a waveform, which controls phase and amplitude information derived in accordance with the present invention.

The EO crystal (14) has an optical axis that must be properly oriented for the EO crystal (14). To improve detection efficiency, the THz pulse (12) is preferably focused onto the EO crystal (14) using the lens (62), such as a silicon lens. As one embodiment, a 500 micrometer thick $LiTaO_3$ crystal might be employed, with its C-axis parallel to the electric field polarization of the incoming radiation. This sensing arrangement satisfies the desired phase-matching condition, which in $LiTaO_3$ requires an angle of 71 degrees between the THz pulse (12) and the optical probe pulse (10) as shown best in FIG. 2.

The polarization analyzer (16) may comprise a compensator and a polarizer. By way of specific example, the compensator may comprise a Berek compensator, Part No. 5540, marketed by New Focus Inc. of Sunnyvale, Calif., while the polarizer may comprise a Glen Laser Polarizer, Part No. GLD-M10-850, marketed by Meadowlark Optics of Longmont, Colo.

In addition, a quarter-wave plate compensator can be used to provide an optical bias to the probe pulse (10), which allows the apparatus (40) to be operated linearly. A Wollaston polarizer (WP) is may be used to convert the induced phase retardation of the probe pulse into intensity modulation on two mutually orthogonal, linearly polarized beams. If the EO crystal (14) is birefringent, then a compensator is preferred . If the EO crystal (14) is not birefringent, such as all zinc blend crystals, like GaAs and ZnTe, then a quarter-wave plate may be used in place of the compensator. The (EO) crystal may be any one of a ZnTe crystal, a GaAs crystal, a CdTe crystal, a CdZnTe crystal, or an organic DAST crystal. If desired, a fiber optic link may couple the output of the electro-optical modulator to a detection device.

Figure 3A:
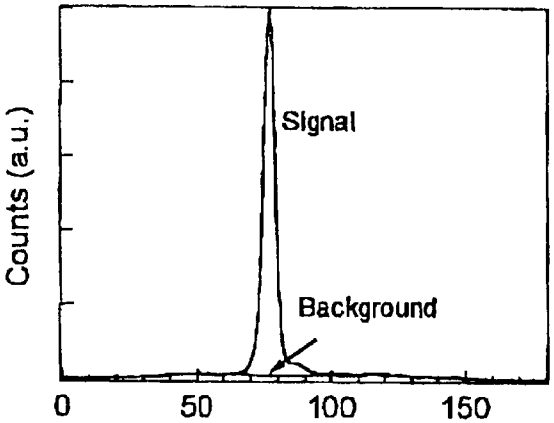
FIGS. 3A, 3B, 3C, and 3D show plots of exemplary measurements of THz pulses using the system of the present invention.
Figure 3B:
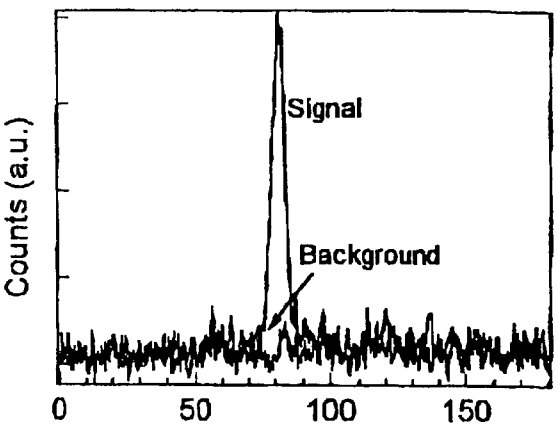
Figure 3C:
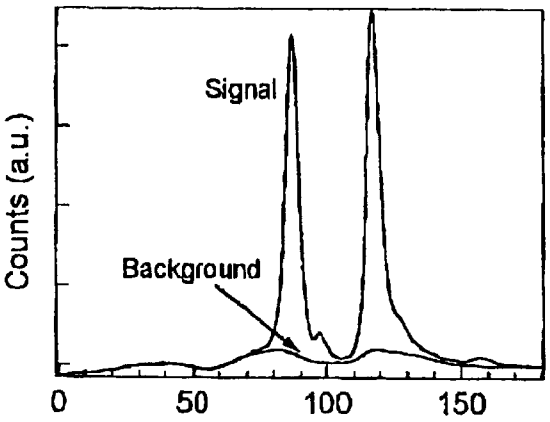
Figure 3D:
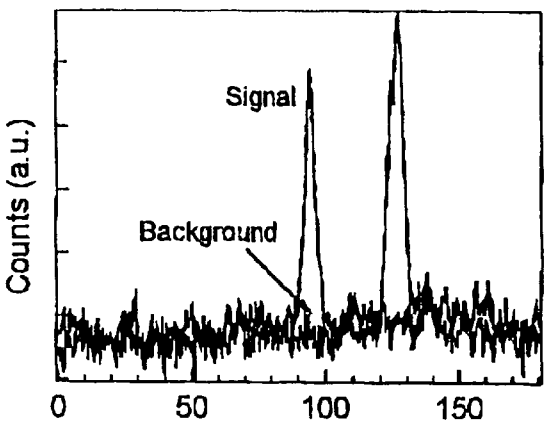

FIGS. 3A, 3B, 3C, and 3D show data collected in accordance with the present invention. Terahertz pulses (12) from the emitter (58) biased at 3.0 kV were measured. FIG. 3A is the averaged measurement of a THz pulse (12), and FIG. 3B is single-shot measurement of the same THz pulse (12). FIGS. 3C and 3D are the averaged and single-shot measurement of two THz pulses (12), respectively. In collecting this data, the electro-optical conversion was at near zero optical bias to increase the modulation depth. The signals, as shown in FIGS. 3A, 3B, 3C, and 3D are well above the background. The full-width-half-maximum (FWHM) of the measured THz pulse (12) is about 4.5 ps. This measurement of the THz pulse (12) is limited only by the temporal resolution of the streak camera (56). This point was confirmed by measuring a laser pulse, with a duration of 250 fs, directly without the EO modulator. The 250 fs laser pulse displayed roughly the same FWHM of 4.5 ps from the streak camera (56).

The measurable window is determined by the probe pulse duration. The probe pulse duration can be adjusted via the grating pair separation used to stretch the probe pulse.

Figure 4B:
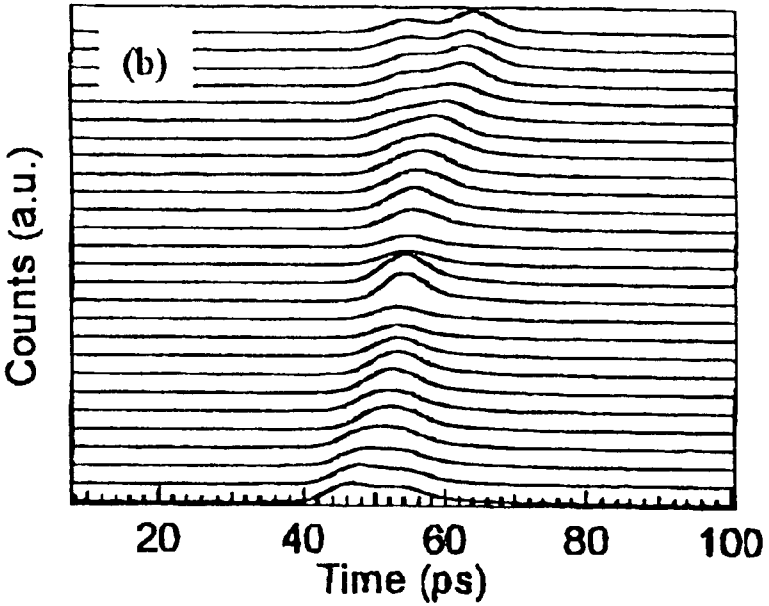
FIGS. 4A and 4B show plots of exemplary measurements of two THz pulses using the system of the present invention.
Figure 4A:
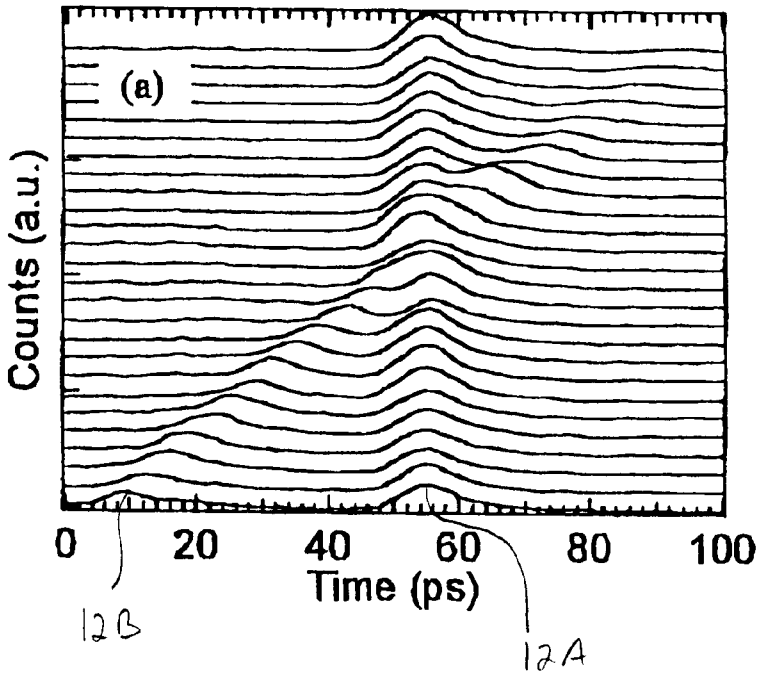

Terahertz pulses (12) can be measured and displayed on the screen of the computer (38) in real time. For the measurements of double THz pulses (12), as shown in FIGS. 3C and 3D, coherent superposition of two THz pulses (12) may be monitored in real time while the time separation between them varies. The results are shown in FIGS. 4A and 4B with the step size of 3.3 ps and 0.67 ps, respectively. The data shown in FIG. 4A display the measurements of two THz pulses (pulse 12A and pulse 12B), and the coherent superposition of the pulses is shown in increments of 3.3 ps. The same pulses are shown in FIG. 4B where the coherent superposition is displayed in 0.67 ps steps. Features of the constructive and destructive interferences of the pulses can be observed in this data.

Figure 5A:
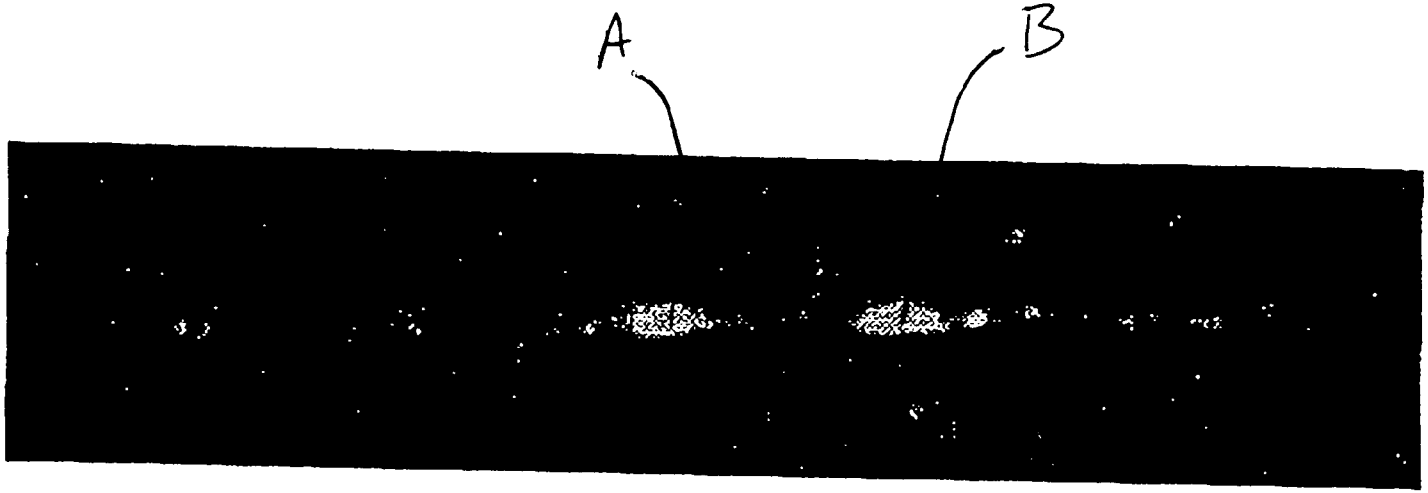
FIG. 5A shows a single-shot trace of a pair of THz pulses and FIG. 5B shows the background trace.
Figure 5B:
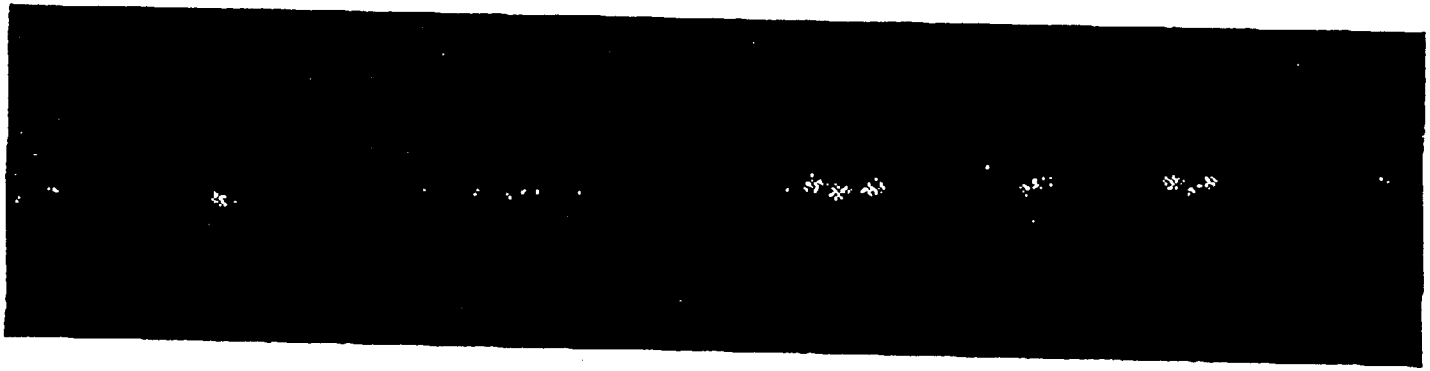

FIG. 5A shows a single-shot trace of a pair of THz pulses and FIG. 5B shows the background trace. The bright spots, A and B, are the THz pulses 12A and 12B, respectively. The measurement technique, as exemplified in these traces, is capable of providing a high signal-to-noise contrast ratio.

Some variations, which may improve the signal, include using an unstretched probe pulse along with the stretched, THz modulated, probe pulse to obtain a dynamic, temporal marker. This marker serves to correct for time jitter in multiple average measurements. In addition, a dynamic subtraction technique and spatial-temporal imaging similar to techniques used with chirped pulse measurements can also be adopted.

The intensity of the transmitted light through the polarizer can be described by the following equation:

$$I=I_0[\eta+\sin^2(\Gamma_0+\Gamma)] \quad \text{(EQN. 1)}$$

where $I_0$ is the intensity of the incident light; $\eta$ represents the scattering contribution of the EO crystal (14) and the imperfection of the polarizers and other optics between the polarizers; $\Gamma_0$ is the optical bias caused by the residual birefringence of the EO crystal (14); and $\Gamma$ is the phase proportional to the electric field of the THz signal and to the thickness and electro-optic coefficient of the EO crystal (14). If group velocity matching between the THz field and the optical probe pulse is achieved, then:

$$\Gamma=\pi d n^3 \gamma_{41} E A \lambda \quad \text{(EQN. 2)}$$

where d is the crystal thickness; $\gamma_{41}$ is the electro-optic coefficient; $\gamma$ is the wavelength of the probe pulse (10); and E is the electric field of the THz pulse (12). Normally $\Gamma<<1$ and $\Gamma_0<<1$ hold, therefore:

$$I\approx I_0(\eta+\Gamma_0^2)+I_0(2\Gamma_0\Gamma+\Gamma^2)=I_b+I_s \quad \text{(EQN. 3)}$$

where $I_b\equiv I_0(\eta+\Gamma_0^2)$ is the background light and $I_s=I_0(2\Gamma_0\Gamma+\Gamma^2)$. The signal-to-background ratio (or modulation depth) can be increased by effectively decreasing the value of $\eta$. This can be accomplished with the use of good quality polarizers and electro-optical crystals. The EO crystal (14) can be moved to obtain small $\Gamma_0$. In principle, EQN. 3 is a coherent measurement, as the THz amplitude as well as phase can be obtained if $|2\Gamma_0|>|\Gamma|$. When $\Gamma$ is comparable with $\Gamma_0$, I is not linear with $\Gamma$. This non-linearity can be corrected, however, using methods known in the art.

In EQN. 3, the detectivity mainly depends on the scattering parameter $\eta$ since $\Gamma_0$ can be minimized by an optical compensator. For a 4 mm thick ZnTe crystal, if $\eta=10^{-5}$ and $\Gamma_0=0$, then the signal-to-background ratio $\alpha$ is given by:

$$\alpha\equiv I_s/I_b\approx\Gamma^2/\eta=2.7\times10^{-3}E^2 \quad \text{(EQN. 4)}$$

where the unit of E is in V/cm. If, for example, $\alpha=10\%$ is the smallest detectable signal, then the detectivity is approximately $E\approx6$ V/cm.

The data in FIGS. 3A, 3B, 3C, 3D, 4A, 4B, 5A, and 5B demonstrate the measurement of the freely propagating THz pulses (12) using a streak camera (56) attached with an EO crystal (14) as the THz modulator. This is a parallel sampling technique in the time domain, and it provides a method to measure single-shot THz pulses (12). The available frequency regime for this technique is from DC-to several THz. The temporal resolution in this electro-optical streak camera is only limited by the resolution of the optical streak camera. A state-of-the-art streak camera with improved time resolution, such as a 200 fs streak camera, would improve the system time resolution dramatically.

Although illustrated and described above with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A system for measuring a terahertz frequency pulse propagating in a free-space optical path, the system comprising:

an optical streak camera; and an electro-optical modulator positioned before the optical streak camera in the free-space optical path, wherein the streak camera measures an optical intensity as a function of time, and wherein the terahertz frequency pulse comprises subpicosecond free-space electromagnetic radiation with a bandwidth in a range from 10 gigahertz to 40 terahertz, and the terahertz frequency pulse modulates a probe pulse.

2. The system of claim 1 wherein the terahertz frequency pulse is measured in a single shot.

3. The system of claim 1 wherein the modulation of the probe pulse occurs as the terahertz frequency pulse and the probe pulse copropagate in the electro-optical modulator.

4. The system of claim 1 wherein the probe pulse is stretched relative to the terahertz frequency pulse.

5. The system of claim 4 wherein the probe pulse is stretched via a chirped pulse technique.

6. The system of claim 1 wherein the probe pulse is synchronized with the streak camera.

7. The system of claim 1 wherein the electro-optical modulator comprises:

an electro-optical crystal; and a polarization analyzer.

8. The system of claim 7, wherein the electro-optical crystal comprises one of a ZnTe crystal, a GaAs crystal, a CdTe crystal, a CdZnTe crystal, and an organic DAST crystal.

9. The system of claim 7 wherein the polarization analyzer converts a polarization modulation into an intensity modulation.

10. The system of claim 7 wherein the polarization analyzer is in a crossed-polarizer geometry.

11. The system of claim 1 wherein the streak camera comprises an electron tube comprising a photo cathode, an accelerating mesh, at least two electrodes, a multi-channel plate, and a phosphor screen.

12. The system of claim 11 wherein the streak camera further comprises a data processing device to process data from the phosphor screen.

13. The system of claim 12 wherein the data processing device is a CMOS.

14. The system of claim 12 wherein the data processing device is a charge coupled device camera.

15. The system of claim 1 further comprising an optical source, for providing the probe pulse and a pump pulse, and an emitter wherein the pump pulse excites the emitter to emit the terahertz frequency pulse.

16. The system of claim 15 wherein the optical source is a laser.

17. The system of claim 16 wherein the laser is a Ti:sapphire laser.

18. The system of claim 1 further comprising a probe pulse polarizer positioned before the electro-optical modulator in a probe pulse optical path.

19. The system of claim 1 further comprising a trigger to synchronize the streak camera and the probe pulse.

20. The system of claim 19 wherein the trigger is a PIN diode.

21. The system of claim 15 further comprising one or more lenses between the emitter and the electro-optical modulator.

22. A system for measuring a free-space terahertz frequency pulse emitted from an emitter and propagating in an optical path, the system comprising:

an optical streak camera;

an optical source and related optics for providing a pump pulse to excite the emitter to emit the terahertz frequency pulse and a probe pulse to probe the terahertz frequency pulse;

a probe pulse stretcher that produces a stretched probe pulse;

a probe pulse polarizer that produces a polarized stretched probe pulse from the stretched probe pulse;

a trigger that synchronizes the streak camera and the probe pulse; and an electro-optical modulator positioned before the optical streak camera in the optical path, the electro-optical modulator comprising an electro-optical crystal and a polarization analyzer;

wherein an electric field is generated by the terahertz frequency pulse when the terahertz frequency pulse propagates through the electro-optical crystal, the electric field modulates the polarization of the polarized stretched probe pulse in the electro-optical modulator, generating a polarization modulation, wherein the polarization modulation is converted to an intensity modulation by the polarization analyzer, and the intensity modulation is measured by the streak camera.

23. The system of claim 22 wherein the terahertz frequency pulse comprises subpicosecond free-space electromagnetic radiation with a bandwidth in a range from 10 gigahertz to 40 terahertz.

24. The system of claim 22 wherein the electro-optical modulator is in a crossed-polarization geometry.

25. The system of claim 22 wherein an index of refraction of the electro-optical crystal changes as a function of a local electromagnetic field.

26. The system of claim 25 wherein the electro-optical crystal comprises one of a ZnTe crystal, a GaAs crystal, a CdTe crystal, a CdZnTe crystal, and an organic DAST crystal.

27. The system of claim 22 wherein the optical source is a laser and the trigger is a PIN diode.

28. A method for measuring terahertz frequency electromagnetic pulses as a function of time, the method comprising the steps of:

(a) providing an optical pump pulse and an optical probe pulse;

(b) exciting a terahertz frequency emitter with the optical pump pulse to generate an emitted pulse from the terahertz frequency emitter;

(c) stretching the optical probe pulse relative to the optical pump pulse;

(d) polarizing the optical probe pulse;

(e) modulating the probe pulse with a local electromagnetic field generated by the emitted pulse in an electro-optical modulator, the modulating resulting in a probe pulse polarization modulation;

(f) converting the polarization modulation into an intensity modulation; and (g) measuring the intensity modulation as a function of time with a streak camera.

29. The method of claim 28 wherein, in step (e), an index of refraction of an electro-optical crystal within the electro-optical modulator changes as a function of the local electromagnetic field.

30. The method of claim 28 further comprising a step of synchronizing the optical probe pulse with the streak camera.

31. An apparatus for measuring a free-space terahertz frequency pulse in a time-dependent manner, said apparatus comprising:

an electro-optical crystal positioned so that the free-space terahertz frequency pulse passes therethrough, thereby changing an index of refraction of the electro-optical crystal;

means for generating an optical probe signal to impinge the electro-optical crystal simultaneously with the free-space terahertz frequency pulse passing therethrough, the optical probe signal having a polarization modulation after impinging upon the electro-optical crystal;

means for determining the polarization modulation of the optical probe signal after impinging upon the electro-optical crystal;

means for characterizing the free-space terahertz frequency pulse by evaluating the polarization modulation of the optical probe signal; and a streak camera.

32. The apparatus of claim 31 wherein the means for characterizing includes means for determining a change in the index of refraction of the electro-optical crystal by analyzing the polarization modulation of the optical probe signal.

33. The apparatus of claim 31 wherein the optical probe signal comprises a polarized optical probe signal.

34. The apparatus of claim 31 wherein the electro-optical crystal comprises one of a ZnTe crystal, a GaAs crystal, a CdTe crystal, a CdZnTe crystal, and an organic DAST crystal.

35. The apparatus of claim 31 wherein the free-space terahertz frequency pulse comprises subpicosecond free-space electromagnetic radiation with a bandwidth in a range from 10 gigahertz to 40 terahertz.

* * * * *